US006697022B2

(12) United States Patent
Ponce De Leon et al.

(10) Patent No.: US 6,697,022 B2
(45) Date of Patent: Feb. 24, 2004

(54) ANTENNA ELEMENT INCORPORATED IN HINGE MECHANISM

(75) Inventors: Lorenzo A. Ponce De Leon, Lake Worth, FL (US); Gregory P. Cheraso, Wast Palm Beach, FL (US); Robert A. Kroegel, Boynton Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/175,120

(22) Filed: Jun. 19, 2002

(65) Prior Publication Data

US 2003/0234743 A1 Dec. 25, 2003

(51) Int. Cl.[7] ..... H01Q 1/24

(52) U.S. Cl. ..... 343/702; 343/895

(58) Field of Search ..... 343/702, 895, 343/846; 455/89, 90

(56) References Cited

U.S. PATENT DOCUMENTS

| | | | | | |
|---|---|---|---|---|---|
| 5,451,965 | A | * | 9/1995 | Matsumoto | 343/702 |
| 6,011,519 | A | * | 1/2000 | Sadler et al. | 343/742 |
| 6,272,356 | B1 | * | 8/2001 | Dolman et al. | 455/575.3 |
| 6,307,511 | B1 | * | 10/2001 | Ying et al. | 343/702 |
| 6,353,733 | B1 | * | 3/2002 | Murray et al. | 455/90.1 |
| 6,414,643 | B2 | * | 7/2002 | Cheng et al. | 343/702 |

* cited by examiner

*Primary Examiner*—Tan Ho
(74) *Attorney, Agent, or Firm*—Brian M. Mancini; Valerie M. Davis

(57) ABSTRACT

A antenna apparatus for an electronic device having a clam-shell movable housing includes an antenna element that serves as the mechanical spring for a hinge assembly of the clam-shell housing as well as an antenna element resonant at an operating frequency of the electronic device. The antenna element is electrically coupling to a receiver of the electronic device and is also mechanically pre-loaded to the hinge assembly to mechanically rotate a movable portion of the clamshell housing away from a main housing portion.

5 Claims, 4 Drawing Sheets

ANTENNA ELEMENT INCORPORATED IN HINGE MECHANISM

FIELD OF THE INVENTION

The present invention is related to an antenna, and more particularly to an antenna adapted to operate in a hinge assembly of an electronic device.

BACKGROUND OF THE INVENTION

The size of wireless handheld communication devices, such as cellular telephones, is being driven by the marketplace towards smaller and smaller sizes. Consumer and user demand has continued to push a dramatic reduction in the size of communication devices. As these devices become less bulky, users face an increasing number of options for carrying and using the device. For example, portable devices are thin and light enough to be easily carried in a shirt pocket. However, the antennas of such devices, when implemented externally to the device, are prone to damage. Moreover, such antenna systems will still need to properly operate over multiple frequency bands and with various existing cellular system operating modes. In many cases, network operators providing services on one particular band have had to provide service on a separate band to accommodate its customers. For example, network operators providing service on the Global System of Mobile (GSM) communication system in a 900 MHz frequency band have had to also rely on operating on the Digital Communication System (DCS) at an 1800 MHz frequency band. Accordingly, wireless communication devices, such as cellular radiotelephones, must be able to communicate at both frequencies, or possibly a third frequency spectrum, such as the Personal Communication System (PCS) 1900 MHz.

Prior art antenna systems have utilized an extendable antenna shaft and various passive couplings to coils and capacitances to achieve an improved efficiency for the communication device to properly operate at various frequencies. Unfortunately, these systems are still relatively bulky when considering a phone that will possibly be reduced to a credit-card size. In particular, placing a loading coil around a shaft while keeping the shaft mechanically rugged for a small phone would be difficult to achieve. Moreover, due to the existing and future size reductions of phones, any extendable or rigid antenna shaft would necessarily be prone to damage.

The need for enhanced operability of communication devices along with the drive to smaller sizes results in conflicting technical requirements for the antenna. Different operational parameters dictate different antenna solutions and implementation schemes for different operating modes. In addition, the device must meet more stringent mechanical requirements in a manner that is sufficiently rugged. In particular, external antennas are susceptible to flex stresses that can occur when carrying the device in a wallet, purse, pants pocket or shirt pocket during even mild user activities such as bending, walking, and sitting.

One solution has been to enclose the antenna completely within the housing of the communication device. However, this has required making the device housing larger to accommodate the antenna. Further, the antenna has been located closer to the electronics of the device. As a result size has increased, efficiency has decreased, and interference has become an issue. Moreover, the requirement to operate at two or more frequencies creates further problems.

Accordingly, there is a need for an antenna system that is less prone to damage, does not significantly increase the size of the communication device, and is not located next to the electronics of the communication device. It would also be advantageous to provide the antenna structure in a compact, low-cost implementation structure. Further, it would be of benefit to provide multi-frequency operation of the antenna.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENTS

The present invention provides an antenna that is located within a housing of a clamshell type communication device making the antenna less prone to damage. The present invention replaces an existing hinge spring, thereby acting as antenna and hinge, and therefore does not significantly increase the size of the communication device. Further, placing the antenna in the hinge locates it away from the other electronics of the communication device reducing interference. There is a cost savings by removing the existing hinge mechanism of the device and replacing it with a similarly sized antenna-spring element. Other antenna elements can be added to provide multi-frequency operation of the antenna.

The present invention is related to an antenna adapted to receive signals in one or more frequency bands. In particular, antenna comprises a substantially fixed helical coil antenna element, optionally coupled with other antenna element either coiled or straight, connected by a single feed point to a receiver or transceiver. Preferably, a straight wire element is also provided and matching circuit is adapted to provide matching for the antenna element(s). A dielectric material preferably surrounds the straight wire element and provides support for the helical coil antenna. A single connection is used to couple the antenna to the wireless communication device although multiple connections can be used.

Figure 1:
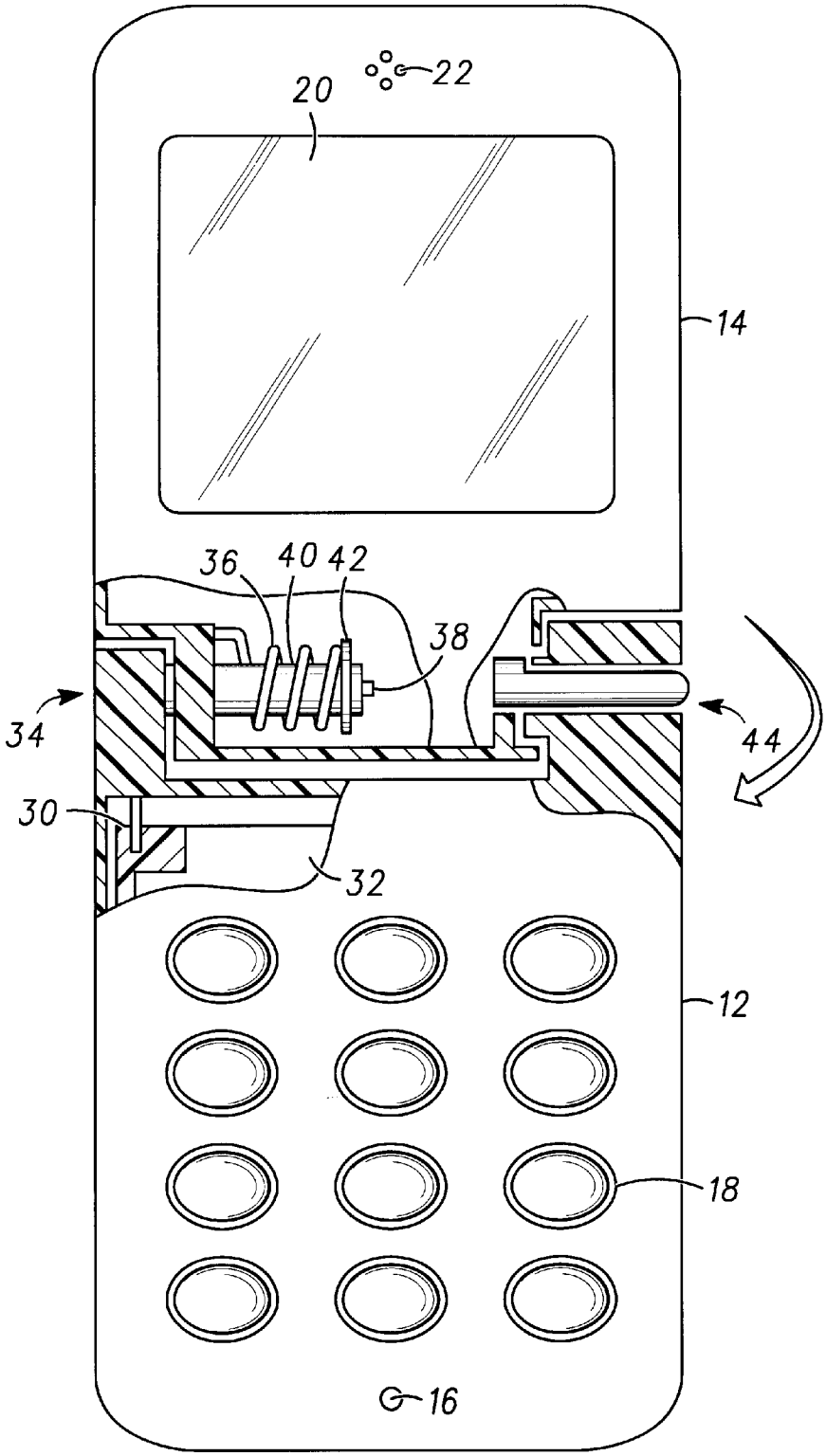
FIG. 1 is a front cut away view of an electronic device with a first and preferred embodiment of an antenna apparatus, in according with the present invention.

Turning first to FIG. 1, a preferred embodiment of an antenna apparatus is shown in an electronic device such as a radiotelephone. The electronic device includes a main housing 12 and a movable housing 14, although these distinctions can be reversed without affecting the invention. The electronic device can include a user interface that includes one or more of a microphone 16, keypad 18, display 20 and speaker 22. In addition, a radio frequency (RF) connection 30 is made from a module or circuit board 32 to the antenna apparatus. The module or circuit board 32 includes a receiver or transceiver circuitry disposed therein and can be contained within the main housing 12 or the movable housing 14, as will be described below. A hinge assembly 34 mechanically couples the main housing 12 and movable housing 14. The movable housing 14 has an open position (as shown) being hinged away from the main housing 12 and a closed position being in proximity to the main housing.

A conductive element 36 is disposed in the hinge assembly 34 and electrically resonant at an operating frequency of the electronic device. The conductive element 36 has an electrical coupling 30 to the electronic device and a mechanical coupling to the hinge assembly that is loaded or biased when the housings are closed together. This loaded mechanical coupling provides a drive to mechanically rotate the movable housing 14 apart from the main housing. Preferably, the conductive element 36 is helically wound in the hinge assembly to form a spring. Alternatively, the conductive element can be configured as any other spring element. For example, the conductive element can be a straight wire that is torsionally pre-loaded.

In its simplest form, the present invention can provide a single antenna (i.e. single conductive element) for operating the electronic device. However, the trend in radiotelephone devices is for operation at multiple bands and/or multiple frequencies. This typically requires an antenna apparatus with more than one operating frequency, requiring more than one antenna element. Therefore, the preferred embodiment of the present invention includes at least one other conductive element 38 being resonant at a second operating frequency of the electronic device. Referring to FIG. 1 a dual-element antenna apparatus is shown, operable on two or more different frequencies. In general, the two or more operating frequencies are chosen to have substantially non-overlapping frequency bands. However, the two or more frequencies can be the same or close to each other to provide a wider bandwidth than is available with a single antenna element. In addition, three or more antenna element can be used, provided that at least one of them acts as a mechanical spring, in accordance with the present invention.

Figure 2:
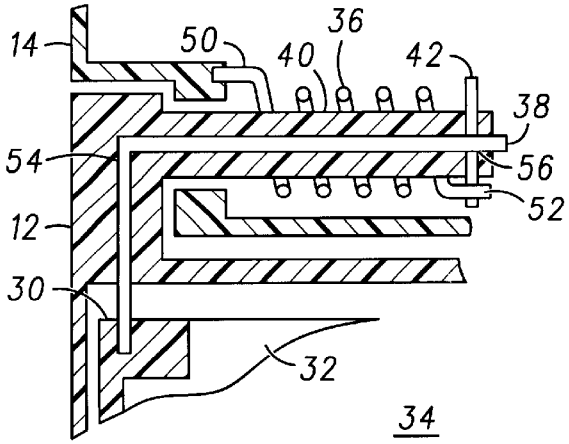
FIG. 2 is a cross sectional view of the antenna apparatus of FIG. 1.

In operation, and referring to FIGS. 1 and 2, the second conductive element 38 is rigidly held in a dielectric shell or core 40 to the main housing 12. The core 40 serves as a rotational shaft of the hinge assembly 34. There is an electrical coupling 30 from the electronic device to a first end 54 of the element 38. At a second end 56, the element 38 is electrically coupled to a conductive lock washer 42, which is fixed to either or both of the dielectric core 40 or second conductive element 38. The lock washer 42 is also electrically connected to a first end 52 of the first conductive element 36, which is fixed to the movable housing 14 at a second end 50. In this way, the first and second conductive elements are electrically connected together at one point 52, while the first conductor 36 is electrically isolated at one end 50. Upon closing of the movable housing against the main housing, the first end 52 of the element 36 is twisted while the other end 50 is fixed, resulting in a spring pressure being exerted against the rotation. This pressure serves to open the device when the movable housing is released by a latch mechanism (44 in FIG. 1).

Figure 3:
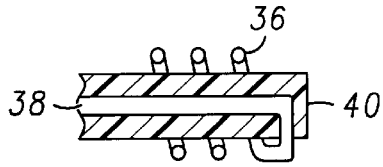
FIG. 3 shows an alternate connection for the antenna apparatus of FIG. 2.

FIG. 3 shows an alternative configuration where a lock washer is not used and the elements 36,38 are directly connected in the core 40. Although simpler to visualize this alternative is harder to implement. In another alternative configuration of FIG. 2, the lock washer is non-conductive or does not connect the elements 36,38. For example, in some cases it may be desirable to form the antenna structure from only the second conductive element 38 and/or extensions (reference 39 in FIG. 9). In such a case, the coil element 36 is strictly a mechanical device and is not part of the antenna. This requires that the lock washer 42 is designed so that there is no electrical contact between the element 36,38. This can be done by making the washer 42 non-conductive, or restrict its conductive portions such that they do not contact the shaft of element 38.

Figure 4:
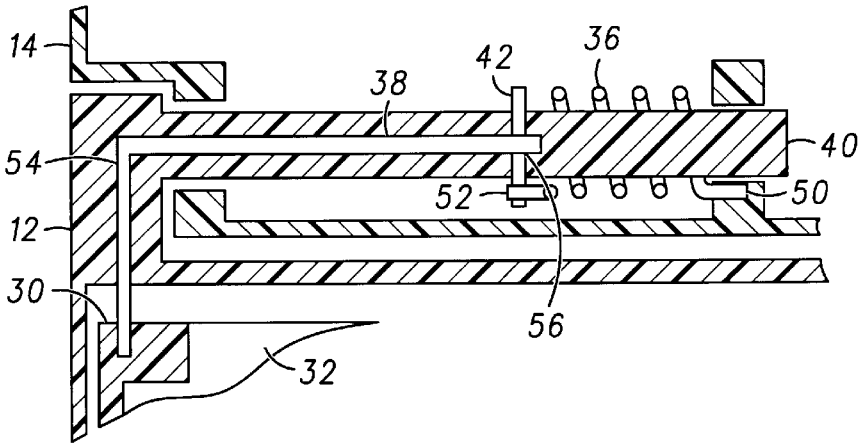
FIG. 4 is a cross sectional view of a second embodiment of an antenna apparatus, in according with the present invention.
Figure 5:
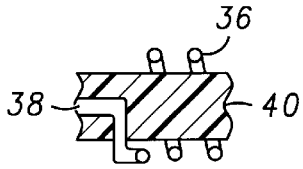
FIG. 5 shows an alternate connection for the antenna apparatus of FIG. 4.

FIG. 4 shows a second embodiment of the present invention, wherein the antenna apparatus is identical to that described for FIG. 2, with the exception that the conductive element 36 is mirror-imaged onto a longer core 40. In this configuration, there is less coupling between elements 36,38 which is an advantage where a sufficiently long hinge assembly 34 is available in the device for both elements. FIG. 5 shows an alternative configuration where a lock washer is not used and the elements 36,38 are directly connected in the core 40. Although simpler to visualize this alternative is harder to implement.

Figure 6:
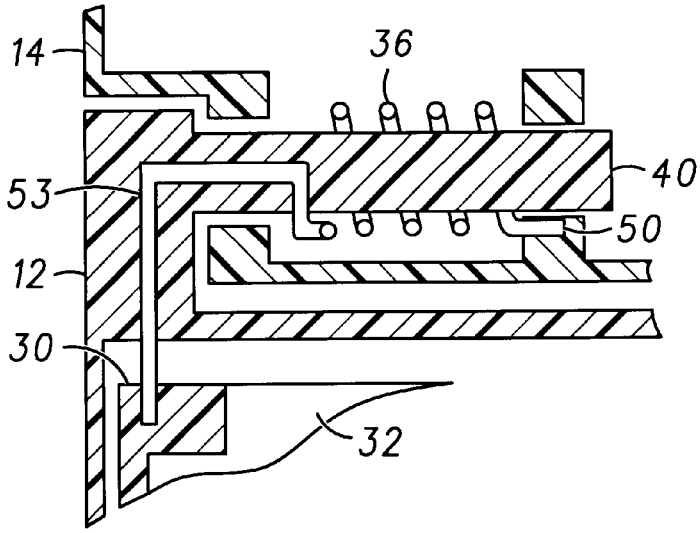
FIG. 6 is a cross sectional view of a third embodiment of an antenna apparatus, in according with the present invention.

FIG. 6 shows a third, simplified embodiment of the present invention, where only a single conductive element is shown. In this case, the element is rigidly held in the main housing and electrically connected at one end 53 to the connection 30 to the device, while the other end 50 is rigidly held and electrically floating in the movable housing. The closing of the device affects the same spring action as previously described.

Figure 7:
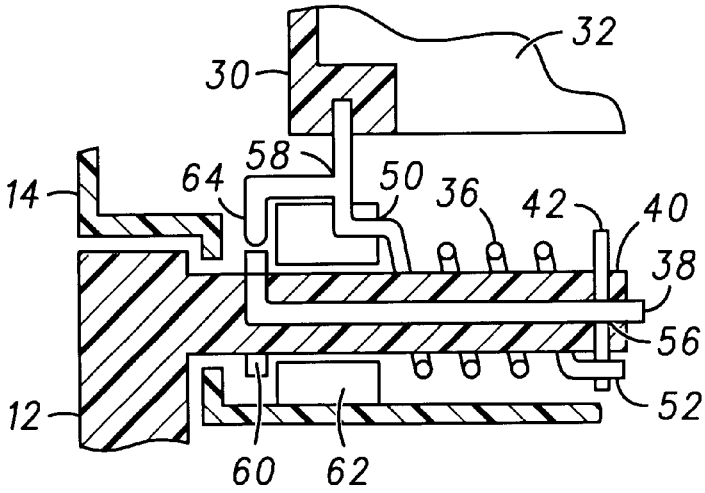
FIG. 7 is a cross sectional view of a fourth embodiment of an antenna apparatus, in according with the present invention.

FIG. 7 shows a fourth embodiment, where the antenna assembly and electrical connection 30 are all contained within the movable housing. In this instance, the electrical coupling 30 includes a common connection 58 from the movable housing 14 of the device to both conductive elements 36,38. In this case, the first conductive element again fixed at one end 52 to a lock washer 42 (or direct connection) and mechanically coupled to a rotating collar 62. When the device housings are closed together the one end 52 of the element 36 now stay relatively motionless while the other end 50 rotates about the collar 62 causing spring tension. In addition, as the core rotates in the collar the second conductive element is electrically coupled to the connection 30 via an electrical slip ring 60 and contact 64. This embodiment serve to provide an antenna apparatus with a common parallel feed point 58, in contrast to the previous embodiments having a serial connection. It should be recognized that the lock washer can also be replaced with a hard connection (not shown) as before.

Figure 8:
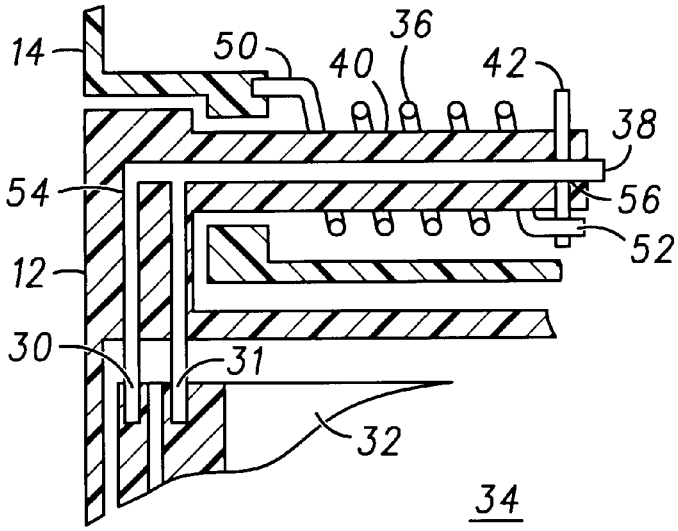
FIG. 8 is a cross sectional view of a fifth embodiment of an antenna apparatus, in according with the present invention.

FIG. 8 shows a fifth embodiment derived from that of FIG. 2. In this embodiment, a ground connection 31 is made from the second conductive element 38 to a ground of the circuit board. In this way, the antenna can be self-matched for impedance, such as for a 50 ohm match, by providing the ground connection in a shunt (gamma) feed network configuration.

Figure 9:
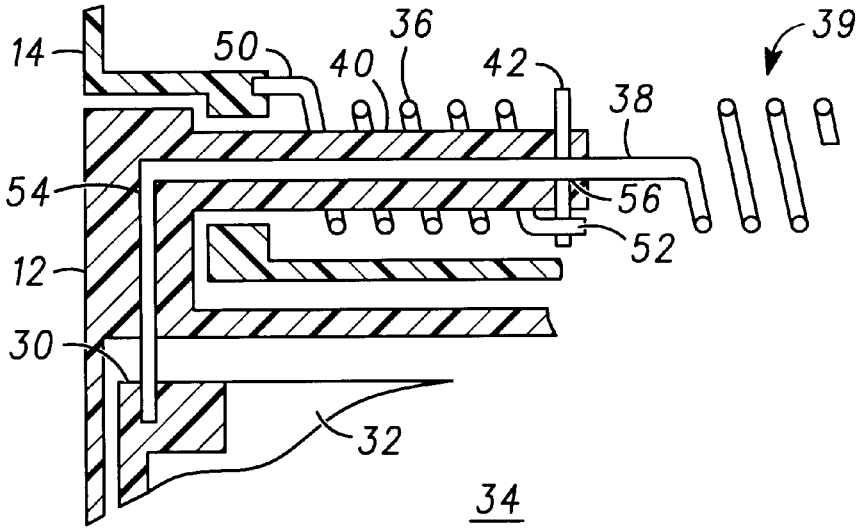
FIG. 9 is a cross sectional view of a sixth embodiment of an antenna apparatus, in according with the present invention.

FIG. 9 shows a sixth embodiment derived from that of FIG. 2, wherein a third conductive element 39 is coupled to one of the other conductive elements 36,38. The third conductive element 39 adds further operating frequency bands to the antenna. The third conductive element 39 can consist of a straight portion, a coil portion or a combination of the two.

In it also envisioned that the present invention can include one element being electrically coupled to RF components in the main housing and the other element being electrically coupled to RF components in the movable housing. In this instance, the elements can be electrically connected together or not.

The preferred embodiment of the present invention utilizes a first conductive element having a helical configuration and a second conductive element having a straight wire configuration. However, two helical elements or two straight wire elements can also be used. The configuration of a straight wire and helical elements having roughly the same dimension is advantageous in those communication systems that require operation at two widely different frequencies. For example, the electronic device can be required to transmit and receive signals in the DCS band (1710–1880 MHz frequencies) and the PCS band (1850–1990 MHz frequencies), while also having the capability to transmit and receive signals in the GSM band (880–960 MHz frequencies). In this case, a helix operates at about half the frequency of a straight wire when they have about the same length. This results in a more compact antenna structure as shown. In contrast, if two helices are used, one element would be about twice the length of the other element, taking up more volume. Therefore, the antenna apparatus configuration of FIG. 1 is preferred. In addition, a substantially straight wire located substantially coaxial with the helical conductive element and the hinge assembly reduces the capacitive coupling between the elements.

In practice, the antenna is coupled and matched to the circuitry of an electronic device as is known in the art. However, there are various other practical considerations to be made, as are known in the art. For example, the length of the monopole generally effects efficiency, where a longer monopole generally provides greater efficiency. Therefore, the length and axial and radial dimensions of the conductive elements are preferably selected to optimize the efficiency of the antenna. That is, the size, length, width and diameter of the elements are selected to provide the proper inductance or capacitance for the antenna, as are known in the art. For example, a narrower element provides greater inductance and wider element provides greater capacitance. In addition, longer elements have lower frequencies.

The antenna structure can also include a protective support and covering as is known in the art. For example, the core can be a molded part of one of the housings. Alternatively, the helical element can be wound on, or in, a dielectric core within an overmold (not shown), which also comprises a dielectric material. For example, the core could be a dielectric material comprising santoprene and polypropylene (e.g. 75% santoprene and 25% polypropylene) to create dielectric material having a dielectric constant of 2.0. Within the dielectric core, a dielectric sleeve can be used to cover the straight wire element. For example, the dielectric sleeve could be a Teflon™ material. In addition to providing a wider bandwidth, the dielectrics provide mechanical strength to the antenna. As long as proper dielectric constants can be found, solid plastic could also be used as shown. Optionally, some areas of the antenna could remain empty, whereby air which has a dielectric constant of one, which also provides good electrical characteristics.

In order to transmit and receive signals in the DCS band (1710–1880 MHz frequencies) and the PCS band (1850–1990 MHz frequencies), a straight wire of approximately 25 mm length is used. In order to transmit and receive signals in the GSM band (880–960 MHz frequencies), the helical coil element is selected to be a length of approximately 20 mm. Notice that changing the wire thickness, pitch dimension, and helical radius can all affect operating frequency. Of course, other dimensions for the frequency bands mentioned or other frequency bands could be used according to the present invention.

Referring back to FIG. 1, it is preferred that the present invention includes a latch assembly 44 to facilitate the opening of the radiotelephone. Many type of latch mechanisms can be used, with the assembly 44 shown to be only one example of such mechanisms. In operation, the antenna/hinge spring is biased or pre-loaded when the housings are closed to drive the device open, i.e. driving the movable housing apart from the main housing. A user will close the movable housing against the antenna/hinge spring until the latch assembly is engaged, locking the device closed and loading the spring. Activation of a button or other device of the assembly 44 releases the latch allowing the loaded antenna/spring to push the movable housing away from the main housing, thereby opening the device.

In summary, the present disclosure is related to an antenna adapted to act as a spring in a hinge mechanism while also provide its normal electrical function of receiving or transmitting electrical signals in one or more frequency band. In particular, the antenna preferably comprises a helical element with a mechanical configuration that resonates at a proper operational frequency when the hinge is expanded to its fully open position, although the helical element also operates with sufficient efficiency when the hinge is closed, slightly compressing (i.e. reducing the diameter of) the helical element.

Although the invention has been described and illustrated in the above description and drawings, it is understood that this description is by way of example only and that numerous changes and modifications can me made by those skilled in the art without departing from the broad scope of the invention. Although the present invention finds particular use in portable cellular radiotelephones, the invention could be applied to any wireless communication device, including pagers, electronic organizers, and computers. Applicants' invention should be limited only by the following claims.

What is claimed is:

1. An antenna apparatus for an electronic device having a main housing and a movable housing, the apparatus comprising:

a hinge assembly mechanically coupling the main housing and movable housing, the movable housing having an open position being hinged away from the main housing and a closed position being in proximity to the main housing;

a conductive element disposed in the hinge assembly and electrically resonant at an operating frequency of the electronic device, the conductive element having an electrical coupling to the electronic device and a biased mechanical coupling to the hinge assembly so as to mechanically rotate the movable housing apart from the main housing; and a shunt ground connection made between one of the conductive elements and a ground, the ground connection and said conductive element providing impedance matching.

2. An antenna apparatus for an electronic device having a main housing and a movable flip housing, the apparatus comprising:

a latch assembly for latching the movable flip housing to the main housing;

a hinge assembly mechanically coupling the main and movable flip housing, the movable flip housing having an open position being hinged apart from the main housing and a closed position latched to the main housing;

a conductive spring element being helically wound in the hinge assembly and electrically resonant at one operating frequency of the electronic device, the conductive element having an electrical coupling to the electronic device and a biased mechanical coupling to the hinge assembly so as to mechanically rotate the movable flip housing apart from the main housing when unlatched from the main housing; and a conductive straight wire with a dielectric shell located substantially coaxial with the at least one conductive element and serving as a rotational shaft of the hinge assembly, the conductive straight wire being electrically resonant at another operating frequency of the electronic device.

3. The apparatus of claim 2, wherein the electrical coupling includes a common connection from the receiver to the straight wire element and spring element.

4. The apparatus of claim 2, wherein the electrical coupling consists of an electrical connection from the receiver to a first end of the straight wire to a second end of the straight wire to a first end of the spring element, wherein the second end of the spring element is electrically isolated.

5. The apparatus of claim 2, further comprising a shunt ground connection made between one of the conductive elements and a ground, the ground connection and said conductive element providing impedance matching.

* * * * *